US006253568B1

(12) United States Patent
Peffley

(10) Patent No.: US 6,253,568 B1
(45) Date of Patent: Jul. 3, 2001

(54) REFRIGERATOR WITH ENHANCED FREEZE COMPARTMENT ACCESS

(76) Inventor: David A. Peffley, 5800 Cody Rd., Rio Rancho, NM (US) 87124

( * ) Notice: Subject to any disclaimer, the term of this patent is extended or adjusted under 35 U.S.C. 154(b) by 0 days.

(21) Appl. No.: 09/470,757

(22) Filed: Dec. 23, 1999

(51) Int. Cl.[7] ..... F25D 11/02

(52) U.S. Cl. ..... 62/441; 312/199; 312/404; 312/405.1

(58) Field of Search ..... 62/340, 440, 441, 62/382; 312/405.1, 404, 200, 201, 199

(56) References Cited

U.S. PATENT DOCUMENTS

| | | | | |
|---|---|---|---|---|
| D. 358,598 | | 5/1995 | Edman . | |
| 2,376,032 | | 5/1945 | Clare . | |
| 2,613,123 | | 10/1952 | Patten . | |
| 2,836,968 | | 6/1958 | Ferris . | |
| 2,893,805 | | 7/1959 | Ferguson . | |
| 4,120,550 | * | 10/1978 | Sherburn | 312/296 |
| 4,536,990 | * | 8/1985 | Siegrist et al. | 49/501 |
| 5,120,118 | | 6/1992 | Rankin . | |
| 5,299,863 | * | 4/1994 | Albright, Jr. | 312/404 |
| 6,055,823 | * | 5/2000 | Baker et al. | 62/441 |
| 6,125,902 | * | 10/2000 | Guddal | 156/390 |

FOREIGN PATENT DOCUMENTS

| | | | | |
|---|---|---|---|---|
| 404068288 | * | 3/1992 | (JP) | F25D/25/00 |

* cited by examiner

*Primary Examiner*—Michael Powell Buiz
*Assistant Examiner*—Mohammad M Ali

(57) ABSTRACT

A a refrigerator with enhanced freezer compartment access for slidably receiving a frame into the freezer compartment. The a refrigerator with enhanced freezer compartment access includes a refrigerator. The refrigerator has a top wall, a back wall, a bottom wall, a first side and a second side, the housing has a middle wall, the middle wall is oriented generally horizontal to the sides, the middle wall divides a refrigeration compartment and a freezer compartment. The freezer compartment is between the first side and the middle wall. A frame is slidably received in the freezer compartment. The frame has a back wall, a top wall, a front wall and a bottom wall. The front wall defines a freezer door. A plurality of racks extends between the freezer door and the back wall. A plurality of guide rails, each having base portion, are mounted to the middle wall and the first side. A plurality of brackets slidably guide the frame in the freezer compartment. The brackets are located on the frame such that the brackets are slidably received in the guide rails.

18 Claims, 3 Drawing Sheets

REFRIGERATOR WITH ENHANCED FREEZE COMPARTMENT ACCESS

BACKGROUND OF THE INVENTION

1. Field of the Invention

The present invention relates to refrigerators and more particularly pertains to a new a refrigerator with enhanced freezer compartment access for slidably receiving a frame into the freezer compartment.

2. Description of the Prior Art

The use of refrigerators is known in the prior art. More specifically, refrigerators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,120,118; U.S. Pat. No. 2,893,805; U.S. Pat. No. 2,376,032; U.S. Pat. No. 2,613,123; U.S. Pat. No. 2,836,968; and U.S. Pat. No. 358,598.

While these devices fulfill their respective, particular objectives and requirements, the aforementioned patents do not disclose a new a refrigerator with enhanced freezer compartment access. The inventive device includes a refrigerator. The refrigerator has a top wall, a back wall, a bottom wall, a first side and a second side, the housing has a middle wall, the middle wall is oriented generally horizontal to the sides, the middle wall divides a refrigeration compartment and a freezer compartment. The freezer compartment is between the first side and the middle wall. A frame is slidably received in the freezer compartment. The frame has a back wall, a top wall, a front wall and a bottom wall. The front wall defines a freezer door. A plurality of racks extends between the freezer door and the back wall. A plurality of guide rails, each having base portion, are mounted to the middle wall and the first side. A plurality of brackets slidably guide the frame in the freezer compartment. The brackets are located on the frame such that the brackets are slidably received in the guide rails.

In these respects, the a refrigerator with enhanced freezer compartment access according to the present invention substantially departs from the conventional concepts and designs of the prior art, and in so doing provides an apparatus primarily developed for the purpose of slidably receiving a frame into the freezer compartment.

SUMMARY OF THE INVENTION

In view of the foregoing disadvantages inherent in the known types of refrigerators now present in the prior art, the present invention provides a new a refrigerator with enhanced freezer compartment access construction wherein the same can be utilized for slidably receiving a frame into the freezer compartment.

The general purpose of the present invention, which will be described subsequently in greater detail, is to provide a new a refrigerator with enhanced freezer compartment access apparatus and method which has many of the advantages of the refrigerators mentioned heretofore and many novel features that result in a new a refrigerator with enhanced freezer compartment access which is not anticipated, rendered obvious, suggested, or even implied by any of the prior art refrigerators, either alone or in any combination thereof.

To attain this, the present invention generally comprises a refrigerator. The refrigerator has a top wall, a back wall, a bottom wall, a first side and a second side, the housing has a middle wall, the middle wall is oriented generally horizontal to the sides, the middle wall divides a refrigeration compartment and a freezer compartment. The freezer compartment is between the first side and the middle wall. A frame is slidably received in the freezer compartment. The frame has a back wall, a top wall, a front wall and a bottom wall. The front wall defines a freezer door. A plurality of racks extends between the freezer door and the back wall. A plurality of guide rails, each having base portion, are mounted to the middle wall and the first side. A plurality of brackets slidably guide the frame in the freezer compartment. The brackets are located on the frame such that the brackets are slidably received in the guide rails.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new a refrigerator with enhanced freezer compartment access apparatus and method which has many of the advantages of the refrigerators mentioned heretofore and many novel features that result in a new a refrigerator with enhanced freezer compartment access which is not anticipated, rendered obvious, suggested, or even implied by any of the prior art refrigerators, either alone or in any combination thereof.

It is another object of the present invention to provide a new a refrigerator with enhanced freezer compartment access which may be easily and efficiently manufactured and marketed.

It is a further object of the present invention to provide a new a refrigerator with enhanced freezer compartment access which is of a durable and reliable construction.

An even further object of the present invention is to provide a new a refrigerator with enhanced freezer compartment access which is susceptible of a low cost of manufacture with regard to both materials and labor, and which accordingly is then susceptible of low prices of sale to the consuming public, thereby making such a refrigerator with enhanced freezer compartment access economically available to the buying public.

Still yet another object of the present invention is to provide a new a refrigerator with enhanced freezer compartment access which provides in the apparatuses and methods of the prior art some of the advantages thereof, while simultaneously overcoming some of the disadvantages normally associated therewith.

Still another object of the present invention is to provide a new a refrigerator with enhanced freezer compartment access for slidably receiving a frame into the freezer compartment.

Yet another object of the present invention is to provide a new a refrigerator with enhanced freezer compartment access which includes a refrigerator. The refrigerator has a top wall, a back wall, a bottom wall, a first side and a second side, the housing has a middle wall, the middle wall is oriented generally horizontal to the sides, the middle wall divides a refrigeration compartment and a freezer compartment. The freezer compartment is between the first side and the middle wall. A frame is slidably received in the freezer compartment. The frame has a back wall, a top wall, a front wall and a bottom wall. The front wall defines a freezer door. A plurality of racks extends between the freezer door and the back wall. A plurality of guide rails, each having base portion, are mounted to the middle wall and the first side. A plurality of brackets slidably guide the frame in the freezer compartment. The brackets are located on the frame such that the brackets are slidably received in the guide rails.

Still yet another object of the present invention is to provide a new a refrigerator with enhanced freezer compartment access that slides out of the refrigerator in order to have complete access to the entire volume of the frame of the freezer.

Even still another object of the present invention is to provide a new a refrigerator with enhanced freezer compartment access that contains guide walls for holding items on racks. The guide walls are movable between a vertical and horizontal position for easy access to the racks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic exploded view of a corner of the present invention.

DESCRIPTION OF THE PREFERRED EMBODIMENT

Figure 1:
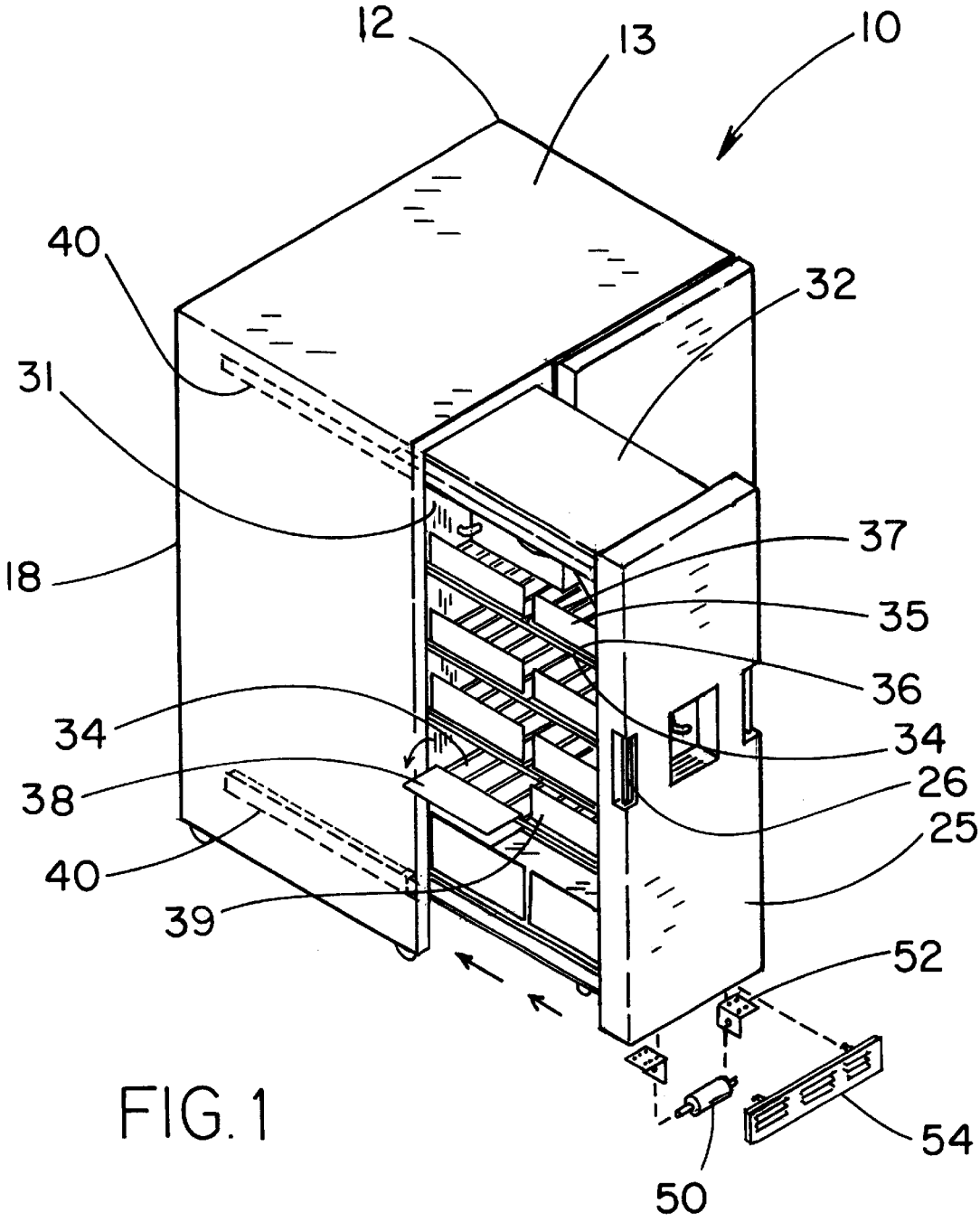
FIG. 1 is a schematic perspective view of a new a refrigerator with enhanced freezer compartment access according to the present invention.
Figure 2:
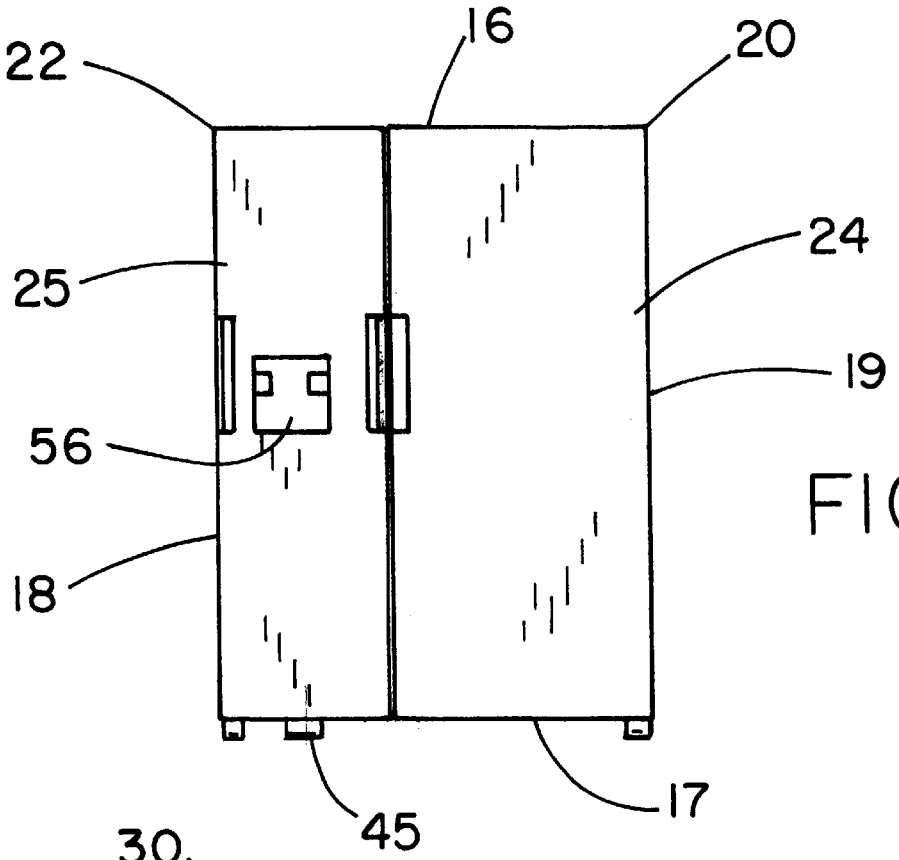
FIG. 2 is a schematic front view of the present invention.
Figure 3:
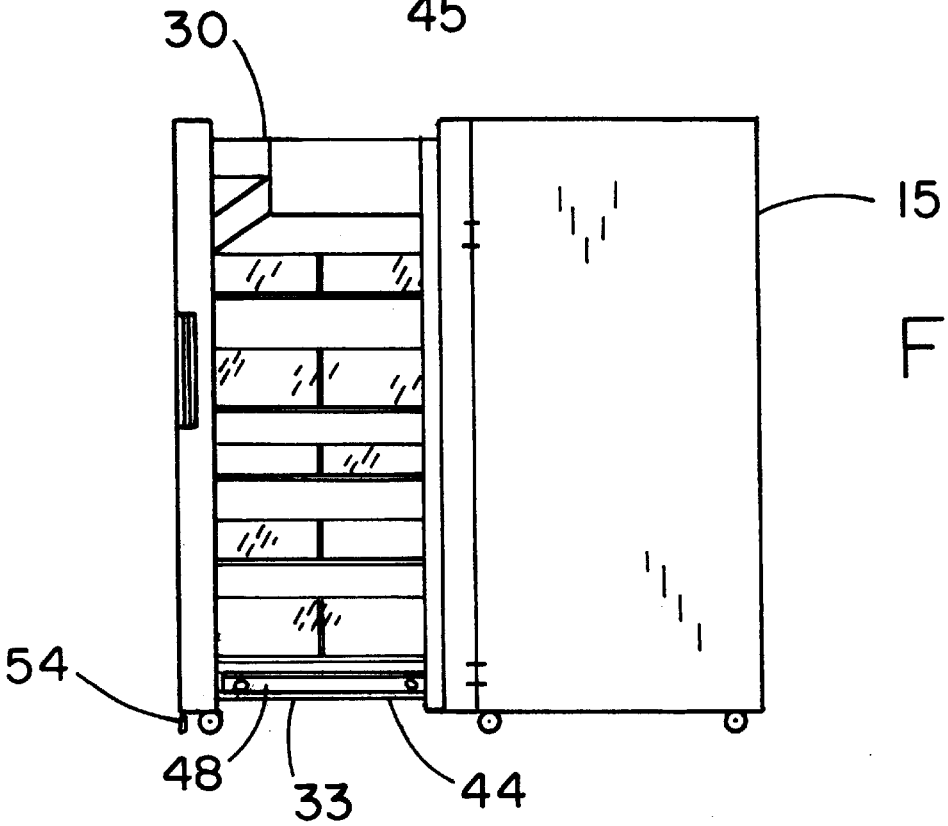
FIG. 3 is a schematic side view of the present invention.
Figure 5:
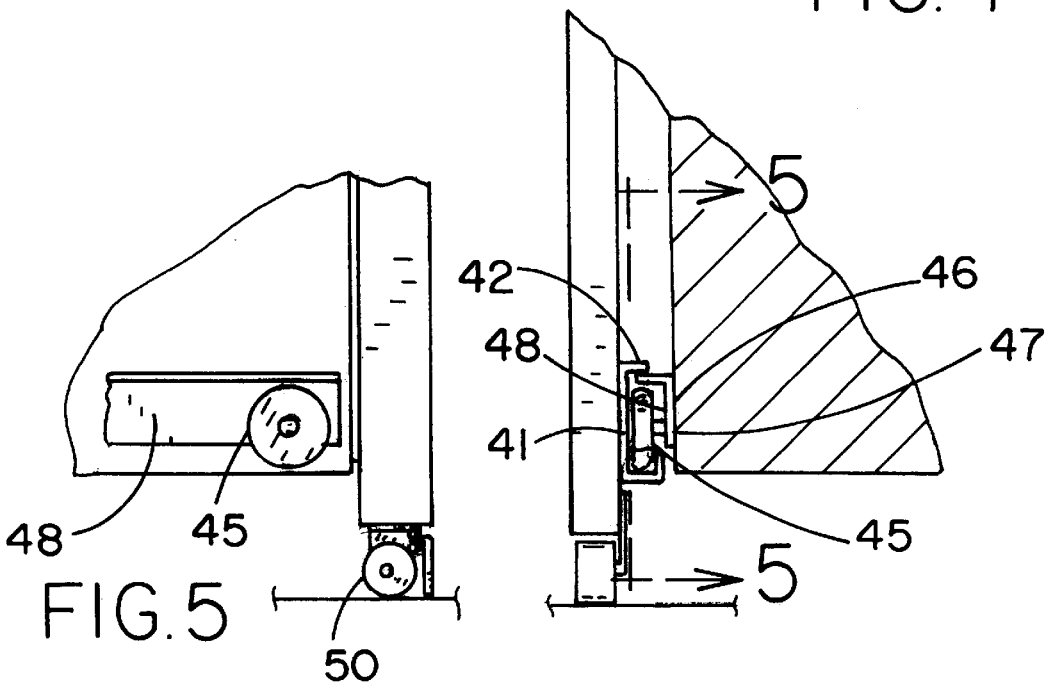
FIG. 5 is a schematic side view taken along line 5—5 of the present invention.
Figure 6:
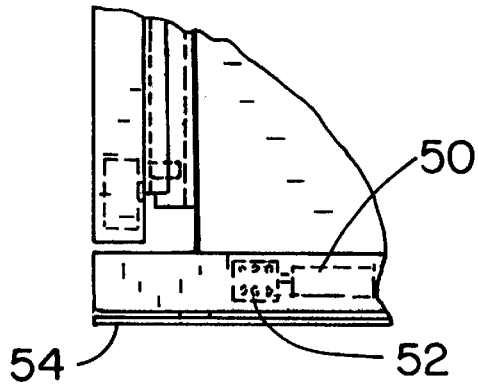
FIG. 6 is a schematic front view of the present invention.

With reference now to the drawings, and in particular to FIGS. 1 through 6 thereof, a new a refrigerator with enhanced freezer compartment access embodying the principles and concepts of the present invention and generally designated by the reference numeral 10 will be described.

As best illustrated in FIGS. 1 through 6, the refrigerator with enhanced freezer compartment access 10 generally comprises a refrigerator. The refrigerator contains a housing 12 having a top wall 13, a back wall 15, a front wall 16, a bottom wall 17, a first side 18 and a second side 19. The housing has a middle wall, not shown, oriented generally horizontal to the sides 18, 19. The middle wall divides a refrigeration compartment 20 from a freezer compartment 22. The freezer compartment 22 is between the first side 18 and the middle wall. The front wall 16 is divided to a form a pair of doors 24, 25. One of the doors 24 forms a door of refrigeration compartment 20, and one of the doors 25 forms a door of the freezer compartment 22 such that a freezer door is defined.

A pair of handles 26 is used for gripping the freezer door 25. One of each of the handles 26 is on an opposite edge of the freezer door. Each of the handles is formed by a cavity in the freezer door.

A frame 30 is slidably receivable in the freezer compartment. The frame has a back wall 31, a top wall 32, and a bottom wall 33. The freezer door 25 forms a front wall of the frame 30. A plurality of racks 34 extends between the freezer door 25 and the back wall 31. Each of the racks 34 are oriented generally perpendicular to the freezer door 25 and the back wall 31.

A plurality of guide walls 35 form a barriers around the racks 34. Each of the guide walls 35 has a first 36 and second 37 opposing edge. Each of the first opposing edges 36 is hingedly coupled to an edge of the racks 34. Each of the guide walls 35 is adapted to move between a vertical closed position 39 and a horizontal open position 38. Each edge of the racks 35 has two guide walls 35 thereon.

A plurality of guide rails 40 each have a base portion 41 and two legs 42 extending therefrom. A base portion 40 of a first guide rail is fixedly coupled to the first side 18. The first guide rail is generally located adjacent to a bottom edge of the first side 18. A base portion of a second guide rail is fixedly coupled to the first side. The second guide rail is generally located adjacent to a top edge of the first side. A base portion of a third guide rail is fixedly coupled to the middle wall. The third guide rail is generally located adjacent to a bottom edge of the middle wall. A base portion of a fourth guide rail is fixedly coupled to the middle wall. The fourth guide rail is generally located adjacent to a top edge of the middle wall. The guide rails 40 are generally U-shaped rails oriented generally parallel to a plane of the top wall 32 of the frame.

A plurality of brackets 44 slidably guide the frame 30 in the freezer compartment. Each of a pair of brackets 44 is coupled to an edge of the bottom wall 33 of the frame 30. Each of a pair of brackets 44 is coupled to an edge of the top wall 32 of the frame. Each of the brackets 44 has a wheel 45 rotatably mounted thereon. Preferably, each of the brackets has two wheels wherein each of the wheels is adjacent to an opposite end of the brackets. The brackets 44 are adapted to be slidably received in the guide rails 40 mounted in the freezer compartment. Each bracket 44 is generally L-shaped having a first side 47 of a long portion 46 coupled to the frame. The wheels 45 are rotatably coupled to a second side 48 of the long portion 46. The wheels 45 having a rotational axis generally perpendicular to the guide rails 40.

A roller 50 for supporting the frame is rotatably coupled to a bottom edge of the freezer door 25. The roller 50 is held by a pair of brackets 52 secured to the bottom edge of the freezer door 25.

A screen 54 for hiding the roller 50 is mounted to the bottom edge of the freezer door 25. The screen 54 is generally flush with a front surface of the freezer door 25.

A securing means 56 retains the device in a closed position with relation to the freezer compartment. The securing means 56 is on a back surface of the freezer door 25. The securing means 56 generally is located adjacent to a peripheral edge of the freezer door 25. The securing means is a magnetic strip.

Ideally, an icemaker 58 for making ice is mounted in the front surface of the freezer door 25 and is preferably located in a middle portion of the front wall.

In use, the frame 30 is slidably removed from the refrigerator so that the racks 34 are fully exposed. The guide walls 25 may be lowered or raised as needed for access so that use has access to the entire volume of the frame.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refrigerator with enhanced freezer compartment access, comprising:

a refrigerator, said refrigerator comprising:

a housing having a top wall, a back wall, a bottom wall, a first side and a second side, said housing having a middle wall, said middle wall being oriented generally parallel to said sides, said middle wall dividing a refrigeration compartment and a freezer compartment, said freezer compartment being between said first side and said middle wall;

a frame for being slidably received in said freezer compartment, said frame comprising:

a back wall, a top wall, a front wall and a bottom wall, said front wall defining a freezer door;

a plurality of racks, each of said racks extending between said freezer door and said back wall;

a plurality of guide rails, each of said guide rails having a base portion mounted to one of said middle wall and first side;

a plurality of brackets for slidably guiding said frame in said freezer compartment, said brackets being located on said frame such that said brackets are slidably received in said guide rails; and a plurality of guide walls for forming a barriers around said racks, each of said guide walls having a first and second opposing edge, each of said first opposing edges being hingedly coupled to one of an edges of said racks, each of said guide walls being adapted to move between a vertical closed position and a horizontal open position.

2. The refrigerator with enhanced freezer compartment access as in claim 1, further comprising:

a pair of handles for gripping said freezer door, each of said handles being on an opposite edge of said freezer door, each of said handles being formed by a cavity in said freezer door.

3. The refrigerator with enhanced freezer compartment access as in claim 1, wherein each of said guide rails has a base portion and two legs extending therefrom, a base portion of a first guide rail being fixedly coupled to said first side, said first guide rail being generally located adjacent to a bottom edge of said first side, a base portion of a second guide rail being fixedly coupled to said first side, said second guide rail being generally located adjacent to a top edge of said first side, a base portion of a third guide rail being fixedly coupled to said middle wall, said third guide rail being generally located adjacent to a bottom edge of said middle wall, a base portion of a fourth guide rail being fixedly coupled to said middle wall, said fourth guide rail being generally located adjacent to a top edge of said middle wall.

4. The refrigerator with enhanced freezer compartment access as in claim 1, wherein each of a pair of brackets is coupled to an edge of said bottom wall of said frame, each of a pair of brackets being coupled to an edge of said of said top wall of said frame, each of said brackets having a wheel rotatably mounted thereon, said brackets being adapted to being slidably received in said guide rails mounted in said freezer compartment.

5. The refrigerator with enhanced freezer compartment access as in claim 1, further comprising:

a roller for supporting said frame, said roller being rotatably coupled to a bottom edge of said freezer door.

6. The refrigerator with enhanced freezer compartment access as in claim 5, further comprising:

a screen for hiding said roller, said screen being mounted to said bottom edge of said freezer door, said screen being generally flush with a front surface of said freezer door.

7. The refrigerator with enhanced freezer compartment access as in claim 1, further comprising:

a securing means for retaining said device in a closed position, said securing means being on a back surface of said freezer door, said securing means generally being located adjacent to a peripheral edge of said freezer door, said securing means being a magnetic strip.

8. The refrigerator with enhanced freezer compartment access as in claim 1, further comprising:

an icemaker for making ice, said ice maker being mounted in said front surface of said freezer door, said icemaker being generally located in a middle portion of said front wall.

9. A refrigerator with enhanced freezer compartment access, comprising:

a refrigerator, said refrigerator comprising:

a housing having a top wall, a back wall, a front wall, a bottom wall, a first side and a second side, said housing having a middle wall, said middle wall being oriented generally parallel to said sides, said middle wall dividing a refrigeration compartment and a freezer compartment, said freezer compartment being between said first side and said middle wall, said front wall being divided to a form a pair of doors, one of said doors forming a door of refrigeration compartment, one of said doors forming a door of said freezer compartment such that a freezer door is defined;

a pair of handles for gripping said freezer door, each of said handles being on an opposite edge of said freezer door, each of said handles being formed by a cavity in said freezer door;

a frame for being slidably received in said freezer compartment, said frame comprising:

said frame having a back wall, a top wall, and a bottom wall, said freezer door forming a front wall of said frame;

a plurality of racks, each of said racks extending between said freezer door and said back wall, each of said racks being oriented generally perpendicular to said freezer door and said back walls;

a plurality of guide walls for forming a barriers around said racks, each of said guide walls having a first and second opposing edge, each of said first opposing edges being hingedly coupled to one of an edges of said racks, each of said guide walls being adapted to move between a vertical closed position and a horizontal open position, each edge of said racks having two guide walls thereon;

a plurality of guide rails, each of said guide rails being having a base portion and two legs extending therefrom, a base portion of a first guide rail being fixedly coupled to said first side, said first guide rail being generally located adjacent to a bottom edge of said first side, a base portion of a second guide rail being fixedly coupled to said first side, said second guide rail being generally located adjacent to a top edge of said first side, a base portion of a third guide rail being fixedly coupled to said middle wall, said third guide rail being generally located adjacent to a bottom edge of said middle wall, a base portion of a fourth guide rail being fixedly coupled to said middle wall, said fourth guide rail being generally located adjacent to a top edge of said middle wall;

a plurality of brackets for slidably guiding said frame in said freezer compartment, each of a pair of brackets being coupled to an edge of said bottom wall of said frame, each of a pair of brackets being coupled to an edge of said of said top wall of said frame, each of said brackets having a wheel rotatably mounted thereon, said brackets being adapted to being slidably received in said guide rails mounted in said freezer compartment;

a roller for supporting said frame, said roller being rotatably coupled to a bottom edge of said freezer door;

a screen for hiding said roller, said screen being mounted to said bottom edge of said freezer door, said screen being generally flush with a front surface of said freezer door;

a securing means for retaining said device in a closed position, said securing means being on a back surface of said freezer door, said securing means generally being located adjacent to a peripheral edge of said freezer door, said securing means being a magnetic strip; and an icemaker for making ice, said ice maker being mounted in said front surface of said freezer door, said icemaker being generally located in a middle portion of said front wall.

10. A refrigerator with enhanced freezer compartment access, comprising:

a refrigerator comprising a housing having an interior defined by a top wall, a back wall, a bottom wall, a first side, and a second side, said housing having a middle wall, said middle wall being oriented generally horizontal to said sides, said middle wall dividing said interior into a refrigeration compartment and a freezer compartment, said freezer compartment being between said first side and said middle wall, a height of said refrigerator being defined between said top and bottom walls, said freezer compartment extending from said bottom wall to said top wall such that said freezer compartment has a height substantially equal to said height of said refrigerator;

a frame for being slidably received in said freezer compartment, said frame comprising:

a back wall, a top wall, a front wall and a bottom wall, said front wall defining a freezer door;

a plurality of racks, each of said racks extending between said freezer door and said back wall;

a plurality of guide rails, each of said guide rails having a base portion mounted to one of said middle wall and first side; and a plurality of brackets for slidably guiding said frame in said freezer compartment, said brackets being located on said frame such that said brackets are slidably received in said guide rails.

11. The refrigerator with enhanced freezer compartment access as in claim 10, further comprising a pair of handles for gripping said freezer door, each of said handles being formed by a cavity in opposite edge of said freezer door.

12. The refrigerator with enhanced freezer compartment access as in claim 10, further comprising a plurality of guide walls for forming a barriers adjacent said racks, each of said guide walls having a first and second opposites edge, each of said first opposite edges being hingedly mounted adjacent to an edge of one of said racks such that each of said guide walls is adapted to move between a vertical closed position and a horizontal open position.

13. The refrigerator with enhanced freezer compartment access as in claim 10, wherein each of said guide rails has a base portion and two legs extending therefrom, a base portion of a first guide rail being fixedly coupled to said first side, said first guide rail being generally located adjacent to a bottom edge of said first side, a base portion of a second guide rail being fixedly coupled to said first side, said second guide rail being generally located adjacent to a top edge of said first side, a base portion of a third guide rail being fixedly coupled to said middle wall, said third guide rail being generally located adjacent to a bottom edge of said middle wall, a base portion of a fourth guide rail being fixedly coupled to said middle wall, said fourth guide rail being generally located adjacent to a top edge of said middle wall.

14. The refrigerator with enhanced freezer compartment access as in claim 10, wherein each of a pair of brackets being coupled to an edge of said bottom wall of said frame, each of a pair of brackets being coupled to an edge of said of said top wall of said frame, each of said brackets having a wheel rotatably mounted thereon, said brackets being adapted to being slidably received in said guide rails mounted in said freezer compartment.

15. The refrigerator with enhanced freezer compartment access as in claim 10, further comprising a roller for supporting said frame, said roller being rotatably mounted on said frame adjacent to a bottom edge of said freezer door.

16. The refrigerator with enhanced freezer compartment access as in claim 15, further comprising a screen for hiding said roller, said screen being mounted adjacent to said bottom edge of said freezer door, said screen being generally flush with a front surface of said freezer door.

17. The refrigerator with enhanced freezer compartment access as in claim 10, further comprising a securing means for retaining said device in a closed position, said securing means being on a back surface of said freezer door, said securing means generally being located adjacent to a peripheral edge of said freezer door.

18. The refrigerator with enhanced freezer compartment access as in claim 10, further comprising an ice dispenser for dispensing ice making ice, said ice dispenser being mounted in said front surface of said freezer door.

* * * * *